US010283313B2

(12) United States Patent
Nonoguchi et al.

(10) Patent No.: US 10,283,313 B2
(45) Date of Patent: May 7, 2019

(54) X-RAY GENERATOR AND ADJUSTMENT METHOD THEREFOR

(71) Applicant: Rigaku Corporation, Akishima-shi, Tokyo (JP)

(72) Inventors: Masahiro Nonoguchi, Tachikawa (JP); Manabu Noguchi, Tachikawa (JP); Koichi Kato, Fussa (JP); Ryuji Nishida, Higashikurume (JP); Yuji Kusaka, Hokuto (JP); Masashi Kageyama, Hachioji (JP); Tomohiro Chaki, Tachikawa (JP)

(73) Assignee: RIGAKU CORPORATION, Tokyo (JP)

( * ) Notice: Subject to any disclaimer, the term of this patent is extended or adjusted under 35 U.S.C. 154(b) by 280 days.

(21) Appl. No.: 15/145,107

(22) Filed: May 3, 2016

(65) Prior Publication Data

US 2016/0336140 A1 Nov. 17, 2016

(30) Foreign Application Priority Data

May 11, 2015 (JP) ..... 2015-096316

(51) Int. Cl.
*H01J 35/02* (2006.01)
*H01J 35/08* (2006.01)
(Continued)

(52) U.S. Cl.
CPC ..... *H01J 35/14* (2013.01); *H01J 35/025* (2013.01); *H01J 35/08* (2013.01); *H05G 1/02* (2013.01); *H05G 1/26* (2013.01); *H01J 2235/081* (2013.01); *H01J 2235/086* (2013.01); *H01J 2235/088* (2013.01)

(58) Field of Classification Search
CPC ..... H01J 2335/081; H01J 2335/088
See application file for complete search history.

(56) References Cited

U.S. PATENT DOCUMENTS 4,393,308 A * 7/1983 Anger ..... H01J 37/06 250/396 ML
5,105,456 A * 4/1992 Rand ..... H01J 35/106 378/125

(Continued)

FOREIGN PATENT DOCUMENTS

DE 102010009276 A1 8/2011
EP 1557864 A1 * 7/2005 ..... G01N 23/04

(Continued)

OTHER PUBLICATIONS

European Search Report corresponding to Application No. 16001053.4; dated Oct. 7, 2016.

(Continued)

*Primary Examiner* — David J Makiya
*Assistant Examiner* — Soorena Kefayati
(74) *Attorney, Agent, or Firm* — Cantor Colburn LLP

(57) ABSTRACT

Provided are an X-ray generator capable of easily measuring a beam size of an electron beam on an electron target, and an adjustment method therefor. The X-ray generator includes an electron target including a first metal, a second metal different from the first metal, and a third metal different from the second metal, which are sequentially arranged side by side along a first direction in a continuous manner.

2 Claims, 8 Drawing Sheets

(51) Int. Cl.

| | |
|---|---|
| ***H01J 35/14*** | (2006.01) |
| ***H05G 1/26*** | (2006.01) |
| ***H05G 1/02*** | (2006.01) |

(56) References Cited

U.S. PATENT DOCUMENTS

| | | | | | |
|---|---|---|---|---|---|
| 5,822,394 | A * | 10/1998 | Schardt | H01J 35/10 | 378/125 |
| 5,892,809 | A * | 4/1999 | Wittry | G21K 1/06 | 378/45 |
| 6,778,633 | B1 * | 8/2004 | Loxley | H01J 35/14 | 378/113 |
| 7,949,101 | B2 * | 5/2011 | Morton | G01N 23/06 | 378/124 |
| 9,008,278 | B2 * | 4/2015 | Lee | H01J 5/18 | 378/124 |
| 2002/0186816 | A1 * | 12/2002 | Freudenberger | H01J 35/305 | 378/144 |
| 2004/0114712 | A1 * | 6/2004 | Eppler | G01N 23/04 | 378/25 |
| 2004/0240616 | A1 * | 12/2004 | Qiu | H01J 35/065 | 378/136 |
| 2004/0240618 | A1 * | 12/2004 | McGuire | H01J 35/08 | 378/137 |
| 2006/0115051 | A1 * | 6/2006 | Harding | H01J 35/08 | 378/121 |
| 2010/0290595 | A1 * | 11/2010 | Al-Sadah | H01J 35/08 | 378/138 |
| 2012/0269326 | A1 * | 10/2012 | Adler | H01J 35/08 | 378/138 |
| 2013/0301805 | A1 * | 11/2013 | Hemberg | H01J 35/08 | 378/137 |
| 2014/0105367 | A1 * | 4/2014 | Horvarth | H01J 35/14 | 378/138 |
| 2014/0177801 | A1 * | 6/2014 | Lee | G01N 23/207 | 378/73 |
| 2015/0003587 | A1 * | 1/2015 | Kim | A61B 6/032 | 378/62 |
| 2015/0092924 | A1 * | 4/2015 | Yun | H01J 35/12 | 378/143 |
| 2015/0117616 | A1 * | 4/2015 | Ishii | H01J 35/08 | 378/137 |
| 2016/0233046 | A1 * | 8/2016 | Ishii | H01J 35/08 | |

FOREIGN PATENT DOCUMENTS

| | | | |
|---|---|---|---|
| EP | 1557864 | A1 * | 7/2005 |
| JP | S56145640 | A | 11/1981 |
| JP | 2000133178 | A | 5/2000 |
| JP | 2010146992 | A | 7/2010 |
| JP | 2014503960 | A | 2/2014 |
| WO | 2011104011 | A2 | 9/2011 |
| WO | 2013168468 | A1 | 11/2013 |

OTHER PUBLICATIONS

European Office Action corresponding to Application No. 16001053.4/1212; Dated Feb. 15, 2019.

* cited by examiner

X-RAY GENERATOR AND ADJUSTMENT METHOD THEREFOR

CROSS-REFERENCE TO RELATED APPLICATION

The present application claims priority from Japanese application JP 2015-096316 filed on May 11, 2015, the content of which is hereby incorporated by reference into this application.

BACKGROUND OF THE INVENTION

Field of the Invention

The present invention relates to an X-ray generator, and more particularly, to an X-ray generator having an electron-beam adjusting function and an adjustment method therefor.

Description of the Related Art

In general, in an X-ray generator, an X-ray is generated by causing an electron beam at a high speed to collide against an electron target. Hitherto, a focal spot size of the X-ray emitted from the X-ray generator is generally measured by mounting a screen or the like having a pinhole on an X-ray emitting side of the X-ray generator and photographing a magnified image with an X-ray CCD camera or the like (pinhole photography).

SUMMARY OF THE INVENTION

The X-ray generator is sold under a state of being mounted to a completed product such as an X-ray diffraction (XRD) system or the like. Therefore, it is general to measure the focal spot size of the X-ray emitted from the X-ray generator through the pinhole photography and adjust the electron beam based on a result of measurement so as to adjust the focal spot size of the X-ray in a factory before shipping. After a filament being an electron-beam source is replaced, the focal spot size of the X-ray generated by the X-ray generator changes. In a case where the focal spot size of the X-ray is relatively large, however, the change in focal spot size, which is caused by the replacement of the filament or the like, is not regarded as a serious problem. Therefore, after the completed products are once subjected to shipping inspection in the factory, the X-ray generators are not re-inspected unless any particular problem arises.

Further, when the change in focal spot size of the X-ray is regarded as a problem, the focal spot size of the X-ray is measured again through the pinhole photography so as to adjust the focal spot size of the X-ray. For the adjustment of the focal spot size, the screen or the like having the pinhole is mounted to the X-ray generator. Hence, an optical system included in the completed product is temporarily removed. Therefore, the measurement of the focal spot size of the X-ray through the pinhole photography after the shipment of the completed product requires not only steps and long time for the pinhole photography itself but also readjustment of the optical system of the completed product (system) after the adjustment of the X-ray generator, resulting in a heavy burden on a user. Further, the X-ray CCD camera is required to be installed far away from the X-ray generator so as to photograph the magnified image, and hence the mounting of the X-ray CCD camera to the completed product (system) itself may become difficult. Still further, it is dangerous for general users to directly handle the X-ray generator configured to emit the X-ray that is harmful to human body.

In recent years, the focal spot size of the X-ray emitted from the X-ray generator is required to be further reduced.

For the reduction of the focal spot size, a sectional size (beam size) of the electron beam on the electron target is required to be easily measured to adjust the electron beam so as to adjust the focal spot size of the X-ray. For environmental change such as the replacement of the filament, there arises a need of measurement of the beam size of the electron beam by a general user as needed.

In Japanese Patent Translation Publication No. 2014-503960, there is disclosed a technology of aligning and focusing the electron beam in an X-ray source. For example, as illustrated in FIG. 1a or FIG. 1b of Japanese Patent Translation No. 2014-503960, in an electron-impact X-ray source that uses a liquid metal jet as an electron target, a sensor 52 is arranged downstream of the electron target (interaction region 30). In this case, the sensor 52 detects electrons reaching a region located downstream of the electron target. However, the above-mentioned technology is limited to a case where the electron target is the liquid metal jet. When the electron target is a solid metal, the electrons reaching the region located downstream of the electron target cannot be measured precisely. Therefore, the above-mentioned technology cannot be applied.

The present invention has been made to solve the problem described above, and has an object to provide an X-ray generator capable of easily measuring a beam size of an electron beam on an electron target, and to provide an adjustment method therefor.

(1) In order to solve the above-mentioned problem, according to one embodiment of the present invention, there is provided an X-ray generator, including: an electron target including a first metal, a second metal different from the first metal, and a third metal different from the second metal, which are sequentially arranged side by side along a first direction in a continuous manner; an electron-beam generating unit configured to emit an electron beam to be radiated on the electron target; an electron-beam adjusting unit, which is arranged between the electron-beam generating unit and the electron target, and is configured to adjust the electron beam emitted from the electron-beam generating unit; an electron-beam deflecting unit, which is arranged between the electron-beam adjusting unit and the electron target, and is configured to deflect the electron beam to be radiated on the electron target in the first direction; and an electron detector, which is arranged between the electron-beam adjusting unit and the electron target, and is configured to detect electrons emitted from the electron target.

(2) In the X-ray generator as described in Item (1), the electron-beam adjusting unit may include an electron beam cross-section shaping unit configured to change a sectional shape of the electron beam.

(3) In the X-ray generator as described in Item (1) or (2), the electron-beam adjusting unit may include an electron-beam focusing unit configured to focus the electron beam onto the electron target.

(4) In the X-ray generator as described in any one of Items (1) to (3), the electron-beam adjusting unit may include an electron beam optical-axis adjusting unit configured to adjust an optical axis of the electron beam.

(5) In the X-ray generator as described in Item (1), the X-ray generator may be configured to perform a first measurement including: scanning, by the electron-beam deflecting unit, the electron beam so that a position of the electron beam on the electron target is moved from the first metal to the third metal; and detecting, by the electron detector, the electrons emitted from the electron target at each of a plurality of the positions of the electron beam on the electron target.

(6) In the X-ray generator as described in Item (2), the X-ray generator may be configured to perform: a first measurement including: scanning, by the electron-beam deflecting unit, the electron beam so that a position of the electron beam on the electron target is moved from the first metal to the third metal; and detecting, by the electron detector, the electrons emitted from the electron target at each of a plurality of the positions of the electron beam on the electron target; test electron beam generation including generating, by the electron beam cross-section shaping unit, a test electron beam obtained by rotating the electron beam so that a second direction, which intersects with the first direction, of a cross section of the electron beam on the electron target is oriented to the first direction; and a second measurement including: scanning, by the electron-beam deflecting unit, the test electron beam so that a position of the test electron beam on the electron target is moved from the first metal to the third metal; and detecting, by the electron detector, the electrons emitted from the electron target at each of a plurality of the positions of the test electron beam on the electron target.

(7) In the X-ray generator as described in Item (3), the X-ray generator may be configured to perform, for each of a plurality of focusing degrees at which the electron-beam focusing unit focuses the electron beam, a first measurement including scanning, by the electron-beam deflecting unit, the electron beam so that a position of the electron beam on the electron target is moved from the first metal to the third metal, and detecting, by the electron detector, the electrons emitted from the electron target at each of a plurality of the positions of the electron beam on the electron target.

(8) According to one embodiment of the present invention, there is provided an adjustment method for an X-ray generator, the X-ray generator including an electron target including a first metal, a second metal different from the first metal, and a third metal different from the second metal, which are sequentially arranged side by side along a first direction in a continuous manner, the adjustment method including: performing a first measurement including: scanning the electron beam so that a position of the electron beam on the electron target is moved in the first direction from the first metal to the third metal; and detecting electrons emitted from the electron target at each of a plurality of the positions of the electron beam on the electron target; and acquiring a first width of a cross section of the electron beam along the first direction based on results of detection in the performing of the first measurement.

(9) The adjustment method for an X-ray generator as described in Item (8) may further include: generating a test electron beam obtained by rotating the electron beam so that a second direction, which intersects with the first direction, of the cross section of the electron beam on the electron target is oriented to the first direction; performing a second measurement including: scanning the test electron beam so that a position of the test electron beam on the electron target is moved in the first direction from the first metal to the third metal; and detecting electrons emitted from the electron target at each of a plurality of the positions of the test electron beam on the electron target; and acquiring a second width of the cross section of the electron beam along the second direction based on results of detection in the performing of the second measurement.

(10) In the adjustment method for an X-ray generator as described in Item (8), the performing of the first measurement may be carried out for each of a plurality of focusing degrees at which the electron beam is focused.

According to the present invention, the X-ray generator capable of easily measuring the beam size of the electron beam on the electron target and the adjustment method therefor can be provided.

DETAILED DESCRIPTION OF THE INVENTION

Figure 1:
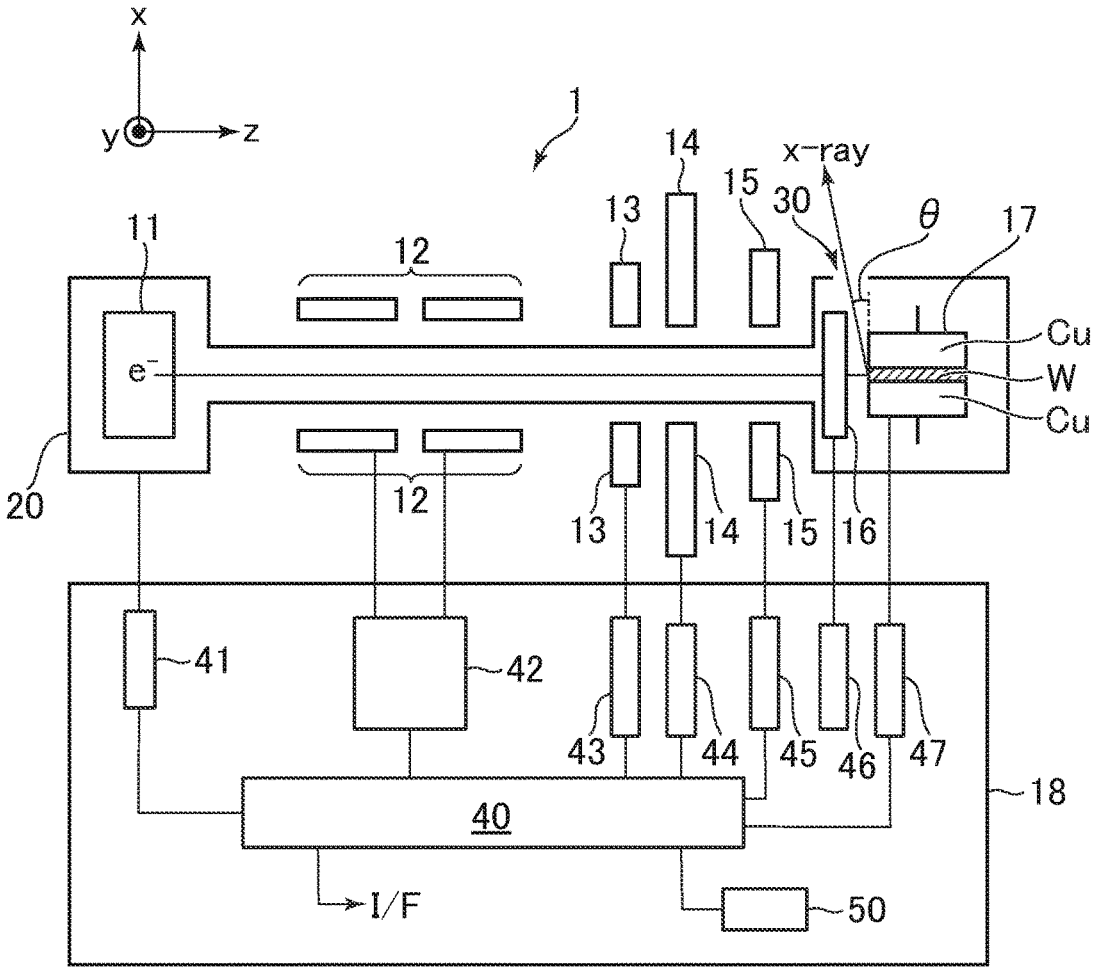
FIG. 1 is a schematic diagram for illustrating the structure of an X-ray generator according to an embodiment of the present invention.

Now, an embodiment of the present invention is described referring to the drawings. For clearer illustration, some sizes, shapes, and the like are schematically illustrated in the drawings in comparison to actual ones. However, the sizes, the shapes, and the like are merely an example, and do not limit understanding of the present invention. Further, like elements as those described relating to the drawings already referred to are denoted by like reference symbols herein and in each of the drawings, and detailed description thereof is sometimes omitted as appropriate.

Figure 2:
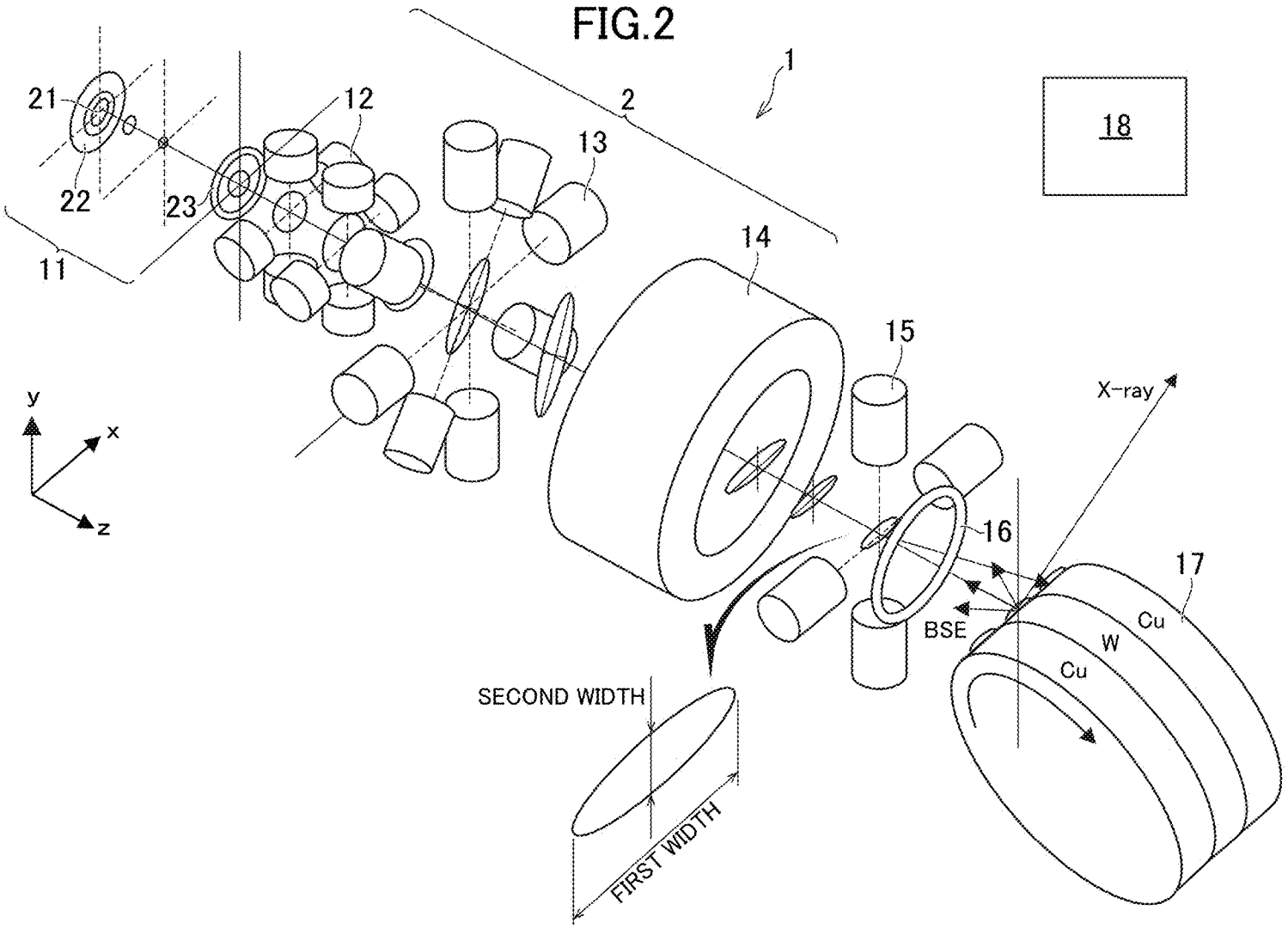
FIG. 2 is a schematic diagram for illustrating the structure of the X-ray generator according to the embodiment of the present invention.

FIG. 1 and FIG. 2 are schematic diagrams for illustrating the structure of an X-ray generator 1 according to the embodiment of the present invention. FIG. 1 is a block diagram of the X-ray generator 1, and FIG. 2 is a perspective view of main components of the X-ray generator 1 with which sectional shapes of an electron beam are illustrated together. In FIG. 1 and FIG. 2, xyz coordinates, which are defined based on an ideal electron beam, are illustrated. A z-axis direction is an optical-axis direction of the electron beam, and an xy plane is a plane perpendicular to the optical axis of the electron beam. An x-axis direction is a flattening direction (long axis direction) in which a cross section of the electron beam radiated on an electron target is flattened, whereas a y-axis direction is a direction (short axis direction) perpendicular to the flattening direction.

The X-ray generator 1 according to this embodiment includes an electron-beam generating unit 11 (electron gun), an alignment coil 12, a deforming and rotating coil 13, a focusing coil 14, a deflecting coil 15, an electron detector 16, a rotor target 17 (electron target), a control unit 18, and a chamber 20 (vacuum chamber). An electron-beam adjusting unit 2 includes the alignment coil 12, the deforming and rotating coil 13, and the focusing coil 14. In the X-ray generator 1 according to this embodiment, a sectional shape of an ideal electron beam on the rotor target 17 is elliptical (elliptical beam). The flattening direction (long axis direction) of the elliptical shape is the same as an axial direction of the rotor target 17. The electron-beam generating unit 11, the electron detector 16, and the rotor target 17 are housed within the chamber 20 whose interior is maintained in a vacuum state. Each of the components included in the electron-beam adjusting unit 2 and the deflecting coil 15 are arranged outside of the chamber 20.

The rotor target 17 is a rotating member having a columnar shape. A plurality of metal regions are formed in a band-like fashion on a side surface of the rotor target 17. The width of the side surface (height of the column) is 40 mm. The electron beam is radiated on the plurality of metal regions formed on the side surface of the rotor target 17, thereby generating an X-ray. Specifically, the plurality of metal regions formed on the side surface of the rotor target 17 correspond to the electron target. In this embodiment, a base of the rotor target 17 is made of copper (Cu). A tungsten (W) metal band having a width of 0.7 mm and width accuracy of 1 μm or smaller is embedded in the base. In this manner, Cu (copper: first metal), W (tungsten: second metal), and Cu (third metal) are sequentially arranged side by side in a first direction (axial direction) in a continuous manner. The second metal is a metal band to be used for adjustment of the electron beam. On both sides of the metal band, the first metal and the third metal are formed. The phrase "the first metal and the second metal are arranged in a continuous manner" means that the first metal and the second metal are held in contact with each other or a gap between the first metal and the second metal is sufficiently smaller than a beam size of the electron beam such that the first metal and the second metal can be regarded as being substantially held in contact with each other. The first metal and the second metal are different metals so that the number of electrons emitted from the rotor target 17 by the radiated electron beam changes at a boundary between the first metal and the second metal. More specifically, it is desirable that an atomic number of one of the first metal and the second metal be 1.5 times as large as that of the other metal or larger. Similarly, although the second metal and the third metal are different metals, the first metal and the third metal may be the same metal. In terms of the adjustment of the electron beam, it is desirable that the first metal and the third metal be the same metal. The electrons emitted from the rotor target 17 are electrons that are backscattered when the electron beam is radiated on the rotor target 17, and contain recoil electrons (having high energy) that are elastically scattered inside the metals corresponding to the electron target so as to be emitted therefrom and secondary electrons (having lower energy than energy of the electrons of the electron beam).

The electron beam collides against the rotor target 17, thereby generating an X-ray. Now, a plane (xz plane) formed by the axis of the rotor target 17 and a long axis of the cross section (ellipse) of the electron beam on the side surface of the rotor target 17 is considered. When an angle formed between the long axis (x-axis direction) and the X-ray in the xz plane is defined as a take-off angle θ, an X-ray window 30 is arranged in a direction that forms θ=14° from a center of a portion where the X-ray is generated (cross section of the electron beam). A part of the X-ray generated by the rotor target 17, which passes through the X-ray window 30, is emitted outside.

A main characteristic of the X-ray generator according to the present invention lies in the electron target including the first metal, the second metal, and the third metal sequentially arranged side by side in the first direction in a continuous manner. The electron beam to be radiated on the electron target can be adjusted based on a length along the first direction of a portion where the second metal is formed.

The electron-beam generating unit 11 includes a filament 21, a Wehnelt 22, and an anode 23. A hole is formed in the anode 23. The filament 21 and the Wehnelt 22 construct a cathode. The electrons emitted from the filament 21 are accelerated and pass through the hole of the anode 23 so as to be emitted outside, thereby forming an electron beam. Specifically, the electron-beam generating unit 11 emits the electron beam to be radiated on the rotor target 17 that is the electron target. The electron beam is focused through the Wehnelt 22 to form a crossover between the filament 21 and the anode 23, and is then spread. Further, the electron beam is adjusted by the focusing coil 14 so that the electron beam forms a focal spot on, for example, the side surface of the rotor target 17. In order to give a smaller focal spot size of the electron beam, it is desirable that a size of the crossover be reduced. Therefore, a material used for the filament 21 is desirably a rare-earth metal compound such as lanthanum hexaboride (LaB6) or cerium hexaboride (CeB6) that can realize a flat small-diameter emitter having a large electron emission density, but the material of the filament 21 is not limited thereto.

The electron-beam adjusting unit 2 is arranged between the electron-beam generating unit 11 and the rotor target 17. The electron beam emitted from the electron-beam generating unit 11 is adjusted so that the electron beam is radiated on the rotor target 17 under desired conditions. In this case, the electron-beam adjusting unit 2 uses the plurality of coils to adjust the electron beam through a magnetic field. Each of the components included in the electron-beam adjusting unit 2 is described later.

The deflecting coil 15 corresponds to an electron-beam deflecting unit configured to deflect the electron beam to be radiated on the rotor target 17, and is arranged between the electron-beam adjusting unit 2 and the rotor target 17. The deflecting coil 15 includes a quadrupole coil, and is capable of deflecting the electron beam that has passed through the deflecting coil 15 in any direction in a plane that perpendicularly passes the optical axis of the electron beam before passage through the deflecting coil 15. A principle of the deflecting coil 15 is the same as that of a deflecting coil of an electromagnetic deflection type cathode-ray tube oscilloscope. In this embodiment, the deflecting coil 15 deflects the electron beam in the flattening direction (long axis direction) of the cross section of the electron beam on the rotor target 17 as a first direction, to thereby scan the electron beam on the side surface of the rotor target 17 in the first direction. A scanning direction of the electron beam is a direction along the axial direction of the rotor target 17, and desirably coincides with the axial direction of the rotor target 17. When the electron beam is scanned by the deflecting coil 15 only in the direction along the axial direction of the rotor target 17, only two-pole coils of the quadrupole coil, which are arranged in the y-axis direction, may be used.

The electron detector 16 detects the electrons emitted from the rotor target 17. The electron detector 16 is arranged between the electron-beam adjusting unit 2 and the rotor target 17. The electron detector 16 may be arranged between the electron-beam adjusting unit 2 and the deflecting coil 15 as long as the electrons that are backscattered by the rotor target 17 can be supplemented. In view of supplementation of a larger amount of electrons, however, it is desirable that the electron detector 16 be arranged between the deflecting coil 15 and the rotor target 17. In this case, the electron detector 16 is a back scattering electron (BSE) detector, and detects the electrons (such as the recoil electrons and the secondary electrons) backscattered by the rotor target 17. The electron detector 16 is in an electrically floating state away from the electron-beam generating unit 11 (filament 21), the rotor target 17, and the chamber 20. The electron detector 16 is connected to a ground potential through a galvanometer. Among the backscattered electrons, the recoil electrons have high energy. Therefore, the recoil electrons can be easily captured even without application of a voltage to the electron detector 16. The electron detector 16 has a ring shape so that the electron beam passes through a hole of the ring shape. The ring shape of the electron detector 16 allows the electron detector 16 to detect the electrons emitted from the rotor target 17 without hampering the radiation of the electron beam onto the rotor target 17. Although the ring shape is desirable as a shape of the electron detector 16 in view of the detection of the electrons, the shape of the electron detector 16 is not limited to the ring shape unless the radiation of the electron beam onto the rotor target 17 is hampered.

The control unit 18 controls the electron-beam adjusting unit 2 to adjust the electron beam so that the electron beam emitted from the electron-beam generating unit 11 is radiated on the rotor target 17 under desired conditions. The control unit 18 includes a CPU 40, an electron-beam generating unit control unit 41, an alignment coil control unit 42, a deforming and rotating coil control unit 43, a focusing coil control unit 44, a deflecting coil control unit 45, an electron detector control unit 46, a rotor target control unit 47, and a memory 50. The electron-beam generating unit control unit 41, the alignment coil control unit 42, the deforming and rotating coil control unit 43, the focusing coil control unit 44, the deflecting coil control unit 45, the electron detector control unit 46, and the rotor target control unit 47 respectively control the electron-beam generating unit 11, the alignment coil 12, the deforming and rotating coil 13, the focusing coil 14, the deflecting coil 15, the electron detector 16, and the rotor target 17. Signal data input to the CPU 40 or output from the CPU 40 can be input and output through an external interface (I/F). The signal data may also be stored in the memory 50. A result of computation performed in the CPU 40 is stored in the memory 50. The result of computation performed in the CPU 40 can be output externally through the external interface (I/F). The control unit 18 is realized by a commercially available computer device and control circuits for the respective components. The control unit 18 may be built in the X-ray generator 1, or the control unit 18 may be partially or entirely arranged outside of the X-ray generator 1.

Next, the components included in the electron-beam adjusting unit 2 are described. The alignment coil 12 is an electron beam optical-axis adjusting unit configured to adjust the optical axis of the electron beam. The optical axis of the electron beam emitted from the electron-beam generating unit 11 is adjusted (aligned) by the alignment coil 12 so that the optical axis of the electron beam becomes closer to a center of a magnetic field generated by the deforming and rotating coil 13 and a center of a magnetic field generated by the focusing coil 14. It is more desirable that the optical axis of the electron beam coincide with the center of the magnetic field generated by the deforming and rotating coil 13 and the center of the magnetic field generated by the focusing coil 14.

The alignment coil 12 includes two coil sets arranged along the optical axis of the electronic beam (z-axis direction), each coil set being a quadrupole coil. A combination of rotation about the x axis and rotation about the y axis is sequentially performed by the two quadrupole coils so that the optical axis of the electron beam can be brought closer to a center of the xy plane while being brought closer to the z-axis direction in parallel thereto.

The deforming and rotating coil 13 is an electron beam cross-section shaping unit configured to change a sectional shape of the electron beam. The cross section of the electron beam is shaped into an elliptical shape by the deforming and rotating coil 13. The deforming and rotating coil 13 includes an octopole coil. The deforming and rotating coil 13 includes the octopole coil so that the cross section of the electron beam can be shaped into the elliptical shape having a desired flattening ratio (ratio of a longer diameter and a shorter diameter) and a desired flattening direction (long axis direction). For example, the cross section of the electron beam is flattened so that the longer diameter becomes, for example, four times as large as the shorter diameter (flattening ratio of 4:1). As described above, the part of the X-ray generated from the rotor target 17, which is emitted in the direction at the take-off angle θ of 14°, is externally emitted. A focal spot size of the X-ray is substantially equal to the beam size of the electron beam that is radiated onto the electron target. When the X-ray is emitted at the above-mentioned take-off angle, an apparent focal spot size of the X-ray is such that the length (longer diameter) of the cross section of the electron beam in the long axis direction on the rotor target 17 is compressed to ¼. Therefore, when the cross section of the electron beam on the rotor target 17 has such an elliptical shape that the longer diameter is four times as large as the shorter diameter, the apparent focal spot of the X-ray becomes a micro focal spot having a circular shape (dot) in this case. When the micro focal spot having a circular shape is desired as the focal spot of the X-ray emitted from the X-ray generator, the flattening ratio of the cross section of the electron beam only needs to be determined in accordance with the take-off angle θ.

Further, when the electron beam passes through the focusing coil 14, not only the electron beam is focused to the focal spot but also the cross section of the electron beam rotates. In the X-ray generator according to this embodiment, the deflecting coil 15 and the electron detector 16 are required to be arranged between the focusing coil 14 and the rotor target 17. Therefore, it is not desirable to further arrange the deforming and rotating coil 13 between the focusing coil 14 and the rotor target 17. Hence, in the X-ray generator according to this embodiment, the deforming and rotating coil 13 is arranged so as to be closer to the electron-beam generating unit 11 than the focusing coil 14. The flattening direction of the cross section of the electron beam after the passage through the deforming and rotating coil 13 only needs to be determined in consideration of a rotation angle of the rotation caused through the passage through the focusing coil 14 so that the flattening direction of the cross section of the electron beam on the rotor target 17 is along the axial direction of the rotor target 17. The deforming and rotating coil 13 can set the flattening direction of the cross section of the electron beam to a desired direction, and hence a test electron beam obtained by rotating the flattening direction of the cross section of the electron beam by 90° can be easily generated.

As described above, the deforming and rotating coil 13 includes the octopole coil. The octopole coil is composed of two quadrupole coils. The two quadrupole coils include a first quadrupole coil arranged so that four poles are oriented in negative and positive directions of the x axis and the y axis and a second quadrupole coil located at positions rotated by 45° from the positions of the first quadrupole coil with respect to the z axis.

The focusing coil 14 is an electron-beam focusing unit configured to focus the electron beam to the rotor target 17. The focusing coil 14 is a magnetic field-type electron lens. The electron beam emitted from the electron-beam generating unit 11 passes through the alignment coil 12 and the deforming and rotating coil 13 while being spread, and is then focused by the focusing coil 14. A focusing distance (focal length of the lens) indicating the degree of focusing the electron beam can be controlled by a current flowing through the focusing coil 14 (focusing-coil current). It is desirable that the electron beam form the focal spot on the side surface of the rotor target 17. As described above, the cross section of the electron beam rotates as the electron beam passes through the focusing coil 14. An orbital rotation angle $\Psi$ of the electrons is expressed by: $\Psi=0.186\cdot I\cdot N/\sqrt{V0}$ (I: the focusing-coil current, N: the number of turns of the focusing coil, V0: an electron accelerating voltage). The electron accelerating voltage V0 is a voltage across the filament 21 and the anode 23.

The structure of the X-ray generator according to this embodiment has been described above. In a related-art X-ray generator, the target is set at a ground voltage. By an electric field formed by three poles corresponding to the ground voltage, a cathode voltage, and a bias voltage, the electron beam emitted from the filament is focused on the target. A focal spot size of the X-ray generated from the X-ray generator described above is Φ70 μm or larger. In order to realize the micro focal spot having the X-ray focal spot size of Φ70 μm or smaller, it is desirable that the electron beam optical-axis adjusting unit, the electron beam cross-section shaping unit, and the electron-beam focusing unit magnetically adjust the electron beam as in the case of the electron-beam adjusting unit of this embodiment. By the X-ray generator including the electron-beam adjusting unit described above, the generation of the X-ray having the focal spot size of Φ70 μm or smaller is realized. It is difficult to realize the X-ray having the focal spot size of Φ50 μm or smaller in the related-art X-ray generator. The generation of the X-ray having the focal spot size typically of Φ20 μm or smaller can be realized by the X-ray generator of this embodiment.

In particular, the electron beam optical-axis adjusting unit, the electron beam cross-section shaping unit, and the electron-beam focusing unit are arranged in the stated order from the electron-beam generating unit side to the electron target side in the electron-beam adjusting unit. As a result, the degree of freedom of a space that is present between the electron-beam focusing unit and the electron target is increased so that the electron-beam deflecting unit, the electron detector, and the like can be arranged as in this embodiment. When the electron beam cross-section shaping unit changes the cross section of the electron beam from the circular shape to a flattened shape, the cross section of the electron beam rotates as the electron beam passes through the electron-beam focusing unit, as described above. However, when the electron beam cross-section shaping unit changes the shape of the cross section of the electron beam in consideration of the rotation angle as in this embodiment, the cross section of the electron beam can be shaped into a desired shape on the electron target even in the above-mentioned arrangement.

The alignment coil 12, the deforming and rotating coil 13, and the focusing coil 14 included in the electron-beam adjusting unit 2 according to this embodiment have a principle in common with components included in an apparatus using the electron beam, such as an electron microscope or an electron beam lithography system. In particular, the deforming and rotating coil according to this embodiment has a principle in common with a stigmator (octopole coil) used for the electron microscope. However, the deforming and rotating coil according to this embodiment is provided for the purpose of intentionally shaping the cross section of the electron beam into the elliptical shape (flattened shape), whereas the stigmator is provided for astigmatism correction, specifically, for the purpose of making the sectional shape of the electron beam closer to the circular shape when the sectional shape of the electron beam is not circular. Therefore, the intended purposes of the deforming and rotating coil and the stigmator are completely different from each other.

Further, the related-art X-ray generator has a small degree of freedom in adjustment of the electron beam. Thus, the focal spot size of the X-ray may vary within a range of about ±5% due to replacement of the filament. In a measurement apparatus (such as a single crystal structural analyzer or an X-ray microscope) including the X-ray generator that emits the X-ray having the focal spot size of Φ70 μm or larger, however, the above-mentioned variation in focal spot size of the X-ray is not regarded as a serious problem. As described above, in order to realize the micro focal spot having the X-ray focal spot size of Φ70 μm or smaller, it is desirable that the electron beam optical-axis adjusting unit, the electron beam cross-section shaping portion, and the electron-beam focusing unit magnetically adjust the electron beam. However, the electron-beam adjusting unit is required to be arranged between the electron-beam generating unit and the electron target in this case. As a result, a distance between the electron-beam generating unit and the electron target becomes extremely longer than (for example, 10 times as large as or longer) that in the related-art X-ray generator. Therefore, the focal spot size is varied sensitively to a fluctuation in current (focusing-coil current) flowing through the focusing coil (focusing lens) that is the electron-beam focusing unit, for example. The electron beam can be adjusted by the present invention, and the present invention has remarkable effects therein. Further, for example, when the cross section of the electron beam on the electron target is excessively reduced by the focusing coil by error, it is considered that the electronic target may be damaged. Therefore, it is important to adjust the electron beam at a low output before the X-ray is emitted at a high output.

Figure 3:
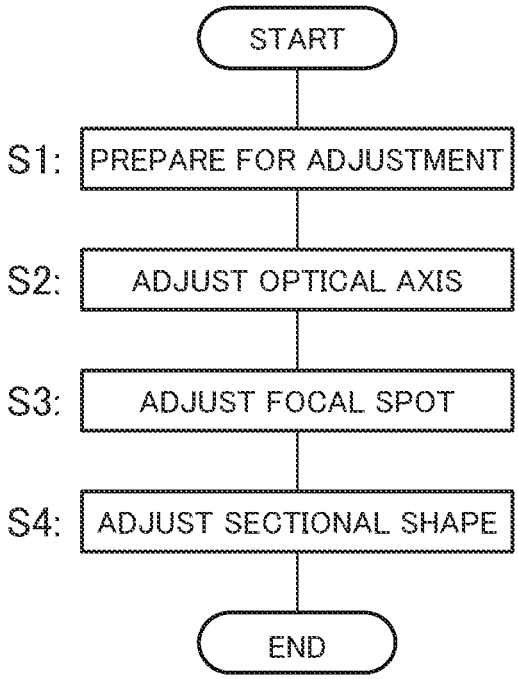
FIG. 3 is a diagram for illustrating an adjustment method for the X-ray generator according to the embodiment of the present invention.

Now, an adjustment method of adjusting the electron beam to desired conditions in the X-ray generator according to this embodiment is described. FIG. 3 is a flowchart for illustrating an adjustment method for the X-ray generator 1 according to this embodiment. The adjustment method described below is realized through control performed by the control unit 18 on the electron-beam adjusting unit 2, the deflecting coil 15 (electron-beam deflecting unit), and the electron detector 16.

[S1: Adjustment Preparatory Step]

First, a state is prepared for adjustment of the electron beam. Specifically, the electron-beam generating unit control unit 41 of the control unit 18 applies the electron accelerating voltage across the filament 21 (cathode) and the anode 23 of the electron-beam generating unit 11. Further, the electron-beam generating unit control unit 41 causes the current to flow through the filament 21 so as to light the filament 21. At this time, the current is set to about 1/10 of the current during general X-ray generation. Then, the electron-beam generating unit control unit 41 applies a bias voltage, and adjusts the bias voltage to an optimal voltage.

The X-ray generator according to this embodiment uses the rotor target 17 as the electron target. For the adjustment of the electron beam, it is desirable to carry out the adjustment in a stationary state after the rotation of the rotor target 17 is stopped. Therefore, it is desirable to control the current flowing through the filament 21 to about 1/10 of the current flowing during the general X-ray generation so that the electron target is prevented from being damaged during the adjustment. Here, the "bias voltage" is a voltage to be applied across the filament 21 (cathode) and the Wehnelt 22 of the electron-beam generating unit 11. By setting the bias voltage to the optimal voltage, the size of the crossover is set to a desired size, desirably, minimized.

[S2: Optical-Axis Adjustment Step]

In this step, the optical axis of the electron beam is adjusted. An index of the adjustment is a target current flowing through the electron target. The rotor target control unit 47 detects the target current. Specifically, the deforming and rotating coil 13 and the focusing coil 14 are controlled to generate high magnetic fields. The alignment coil 12 is adjusted so as to further increase the target current.

The deforming and rotating coil control unit 43 and the focusing coil control unit 44 respectively increase the currents to flow through the deforming and rotating coil 13 and the focusing coil 14 so as to generate the high magnetic fields, desirably, maximize the magnetic fields. Under some situations, it is desirable to adjust the optical axis of the electron beam under a state in which the focusing coil 14 is weakly excited (to about 100 mA) and the focusing and rotating coil 13 is set in an ON state. Further, the deflecting coil control unit 45 sets the deflecting coil 15 in an OFF state. In this case, when the optical axis of the electron beam is distant from the center of the magnetic field generated by the deforming and rotating coil 13 or the center of the magnetic field generated by the focusing coil 14, the electrons are significantly bent by the magnetic fields generated by the coils as the electrons pass through the coils. As a result, the electrons collide against an inner wall (narrow tube) of the chamber 20, failing to reach the rotor target 17. Specifically, the target current is small. By bringing the optical axis of the electron beam closer to the center of the magnetic field generated by the deforming and rotating coil 13 and the center of the magnetic field generated by the focusing coil 14, the target current increases. Therefore, the alignment coil control unit 42 adjusts the current flowing through the alignment coil 12 while monitoring the target current. Desirably, the current that maximizes the target current is set as the current flowing through the alignment coil 12, which is an optimal value of the current. The rotor target 17 is in an electrically floating state (floating state) away from the inner wall (narrow tube) of the chamber 20, the filament 21, and the anode 23. Hence, the target current can be detected.

Figure 4:
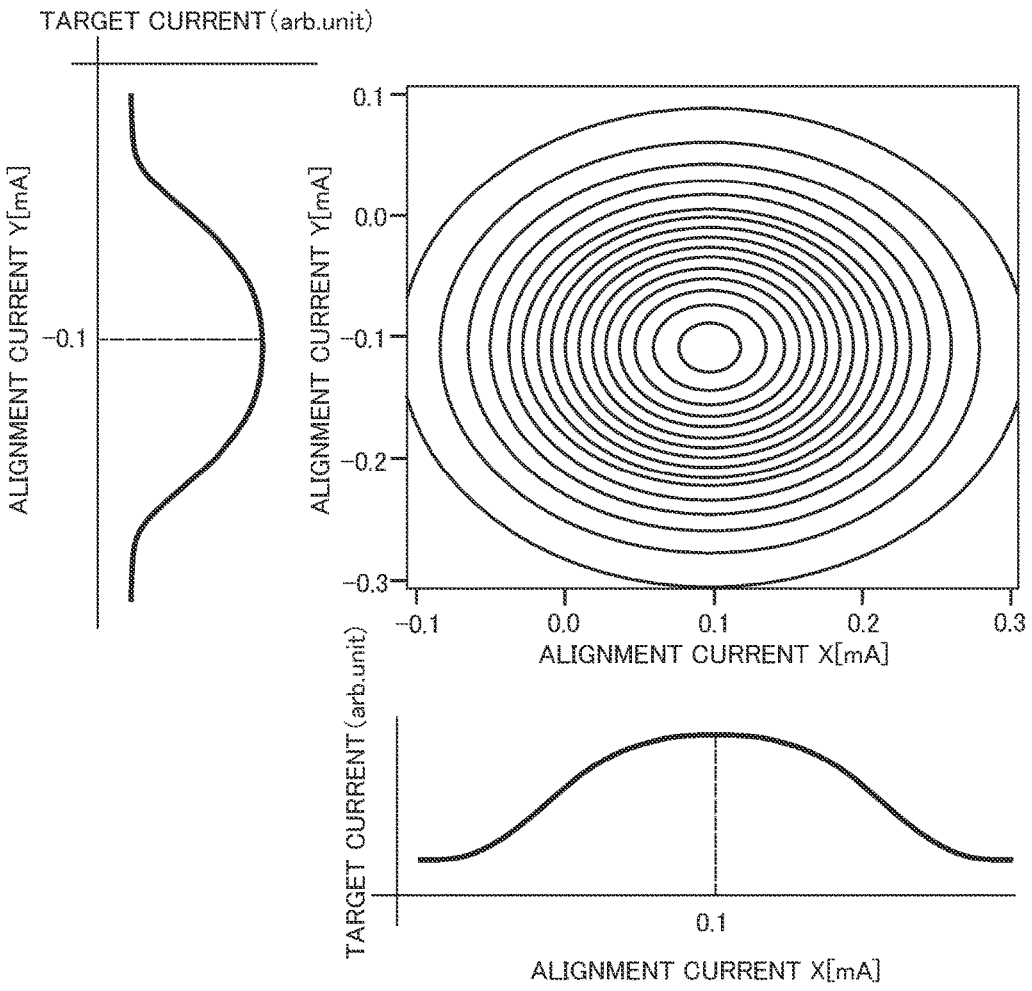
FIG. 4 is a set of graphs for showing an example of optical-axis adjustment in an optical-axis adjustment step according to the embodiment of the present invention.

FIG. 4 is a set of graphs for showing an example of optical-axis adjustment in the optical-axis adjustment step according to this embodiment. A horizontal axis of the graph in the center indicates an alignment current X (mA) for axial adjustment in the x-axis direction, whereas a vertical axis indicates an alignment current Y (mA) for axial adjustment in the y-axis direction. In the graph, a value of the target current is indicated as contours. The lower graph is for showing the target current for the alignment current X when the alignment current Y is Y=−0.1 mA. Similarly, the graph on the left is for showing the target current for the alignment current Y when the alignment current X is X=0.1 mA. In this example of optical-axis adjustment, the target current becomes maximum when X=0.1 mA and Y=−0.1 mA.

[S3: Focal Spot Adjustment Step]

In this step, a focal position of the electron beam is adjusted. An index of the adjustment is the amount of electrons detected by the electron detector. Specifically, the current (focusing-coil current) to flow through the focusing coil 14 is adjusted based on the amount of detected electrons so as to set the cross section of the electron beam on the rotor target 17 to a desired size.

Figure 5:
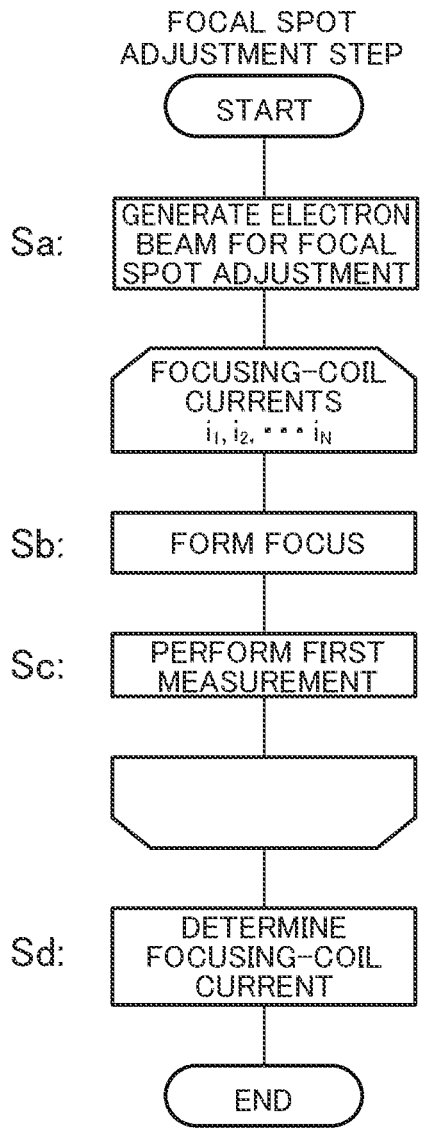
FIG. 5 is a flowchart for illustrating a focal spot adjustment step according to the embodiment of the present invention.

FIG. 5 is a flowchart for illustrating the focal spot adjustment step according to this embodiment. First, the alignment coil control unit 42 causes the alignment current that is adjusted in the optical-axis adjustment step to flow through the alignment coil 12. At the same time, the deforming and rotating coil control unit 43 sets the deforming and rotating coil 13 in an OFF state to generate an electron beam for focal spot adjustment (Sa: step of generating the electron beam for focal spot adjustment). Then, the focusing coil control unit 44 sets the current (focusing-coil current) to flow through the focusing coil 14 so as to focus the electron beam at a focusing degree in accordance with the current (Sb: focus formation step).

Next, a first measurement is carried out at the above-mentioned focusing degree (Sc: first measurement step). In the first measurement in this step, the electron-beam deflecting unit scans the electron beam so that a position of the electron beam on the electron target is moved in the first direction from the first metal to the third metal, and the electron detector detects the electrons emitted from the electron target at each of a plurality of positions of the electron beam on the electron target. Specifically, the deflecting coil control unit 45 changes the current to flow through the deflecting coil 15 so that the deflecting coil 15 deflects the electron beam to scan the electron beam so that the cross section of the electron beam on the rotor target 17 is moved in the first direction (x-axis direction) from the first metal (Cu) to the third metal (Cu). When a center of the cross section of the electron beam on the rotor target 17 is defined as a position of the electron beam on the rotor target 17, the electron detector 16 is controlled by the electron detector control unit 46 to detect the electrons emitted from the rotor target 17 at each of the plurality of positions while the deflecting coil 15 scans the electron beam so that the cross section of the electron beam is moved in the first direction. The amounts of detected electrons at the plurality of positions are plotted to obtain a detected electron profile.

The emitted electrons differ depending on the kind of metal being the electron target. For example, when a certain electron beam is radiated on the metals, the amount of electrons emitted from W (tungsten) is larger than that emitted from Cu (copper). Therefore, when the cross section of the electron beam is entirely contained in a region of the first metal (Cu), the amount of detected electrons is small. When the electron beam is scanned so that the cross section of the electron beam is partially contained in a region of the second metal (W), the amount of detected electrons increases. In a process of scanning the electron beam so that the cross section of the electron beam passes across the boundary between the first metal and the second metal, the amount of detected electrons gradually increases. When the electron beam is further scanned so that the cross section of the electron beam is entirely contained in the region of the second metal (W), the amount of detected electrons is large. Even when the electron beam is scanned in this state, the amount of detected electrons scarcely changes and is substantially constant. Similarly, in a process in which the cross section of the electron beam passes across a boundary between the second metal and the third metal, the amount of detected electrons gradually decreases. When the electron beam is further scanned so that the cross section of the electron beam is entirely contained in a region of the third metal (Cu), the amount of detected electrons becomes small. Even when the electron beam is scanned in this state, the amount of detected electrons scarcely changes and is substantially constant.

The phrase "scan the electron beam so that the position of the electron beam on the electron target is moved in the first direction from the first metal to the third metal" means that the electron-beam deflecting unit deflects the electron beam so that the position of the cross section of the electron beam on the electron target is changed in the first direction from a state in which the cross section of the electron beam on the electron target is entirely contained in the region of the first metal to a state in which the cross section of the electron beam on the electron target is entirely contained in the region of the third metal.

Next, the focusing coil control unit 44 sets the current to flow through the focusing coil 14 to another value so that the electron beam is focused at a focusing degree in accordance with the value of the current (Sb: focus formation step). At the focusing degree, the first measurement is carried out (Sc: first measurement step). For set N (natural number of N≥2) values (current values i1, i2, . . . iN), the first measurement is repeated. Specifically, the first measurement is carried out for each of the N values. Then, based on the results of the first measurement at the plurality of focusing degrees, the current value that gives a desired focusing degree is determined (Sd: focusing-coil current determination step). Specifically, the results of the first measurement at the plurality of focusing degrees are input to the CPU 40 so that detected electron profiles are created at the plurality of focusing degrees. In an analysis implemented by the CPU 40, for example, a differential coefficient is calculated for a curve formed by the detected electron profile. Then, peak values (maximum values) of the differential coefficient in a region across the boundary between the first metal and the second metal are compared. The focusing-coil current giving a maximum peak value is determined as the focusing-coil current that reduces the focal spot size of the electron beam. The focusing-coil current that gives the maximum peak value may be obtained through interpolation from the plurality of profiles. Alternatively, a half-value width of the peak of the differential coefficient may be obtained so that the set value of the focusing-coil current is determined by the focusing-coil current that gives a minimum half-value width. Further, a first width acquisition step described later may be carried out for the result of the first measurement for the focusing-coil current that gives the maximum peak value (minimum half-value width) so as to determine a width of the focal spot (dot) of the electron beam.

Figure 6:
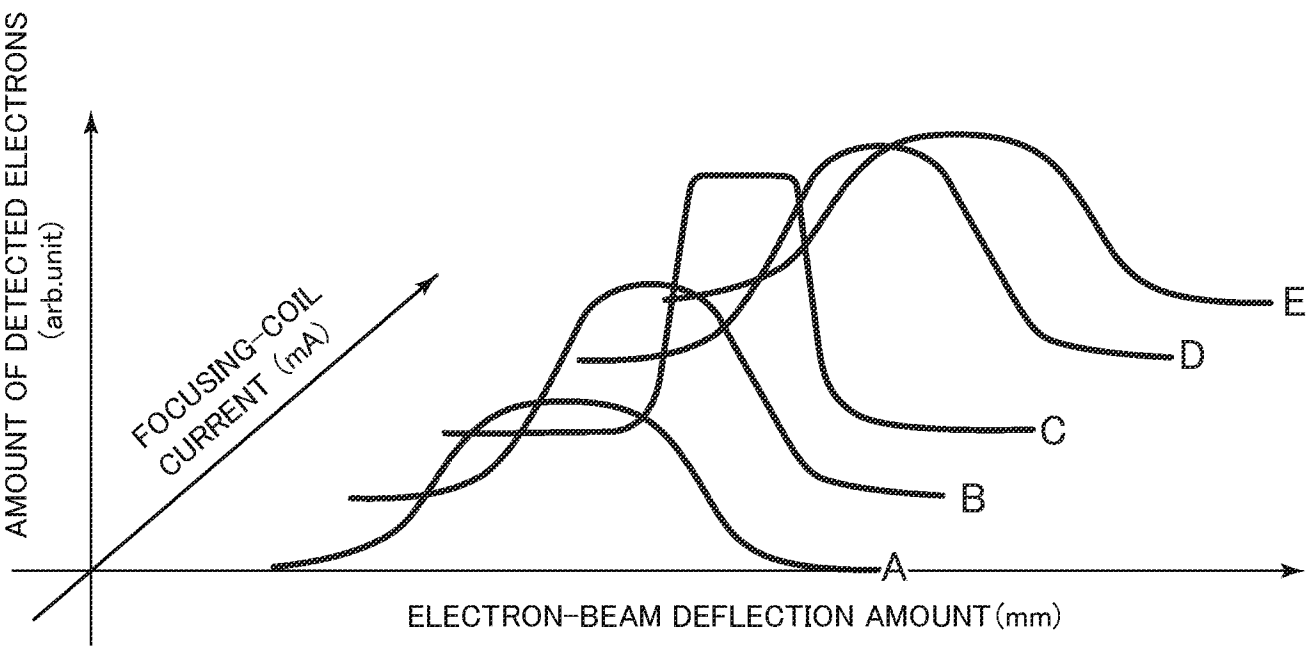
FIG. 6 is a graph for showing an example of focal spot adjustment in the focal spot adjustment step according to the embodiment of the present invention.

FIG. 6 is a graph for showing an example of focal spot adjustment in the focal spot adjustment step according to this embodiment. In FIG. 6, the detected electron profiles at five different values of the focusing-coil current are shown. A horizontal axis of FIG. 6 indicates an electron-beam deflection amount (mm), which indicates a position of the electron beam on the rotor target 17. A vertical axis of FIG. 6 indicates the detected electron amount (arbitrary unit), which indicates the amount of electrons detected by the electron detector 16. For easy comparison between the detected electron profiles at the five current values, five profiles varying from that with a smaller current value (A) to that with a larger current value (E) are shown in a shifted manner. When the electron beam is out of focus and therefore has the larger cross section on the rotor target 17, the increase in amount of detected electrons becomes slower in a process in which the cross section of the electron beam passes across the boundary between the first metal (Cu) and the second metal (W). On the other hand, as the focal spot of the electron beam moves closer to the side surface of the rotor target 17, the cross section of the electron beam decreases so that the amount of detected electrodes increases steeply at the boundary. The same applies to the decrease in the amount of detected electrons in a process in which the cross section of the electron beam passes across the boundary between the second metal (W) and the third metal (Cu).

As shown in FIG. 6, the amount of detected electrons indicated by a third profile (C) changes steeply. Among the five current values, the current value indicated by the third profile (C) is a value of the focusing-coil current that makes the focal spot of the electron beam closest to the side surface of the rotor target 17.

In this embodiment, the focal spot of the electron beam is adjusted by using the profiles obtained by the scanning across the first metal, the second metal, and the third metal. However, the focal spot adjustment is not limited thereto. The electron beam may be scanned with increased resolution only from the first metal to the second metal (or only from the second metal to the third metal). In this case, the focal spot size of the electron beam may be determined based on a difference between a profile shape obtained by a theoretical calculation and an actual profile shape.

[S4: Sectional-Shape Adjustment Step]

In this step, a sectional shape of the electron beam on the electron target is measured so as to adjust the sectional shape of the electron beam. An index of the adjustment is the amount of electrons detected by the electron detector. Specifically, a width (first width) of the cross section of the electron beam on the electron target along the first direction is first acquired. Subsequently, a width (second width) along a second direction that intersects with the first direction is acquired.

Figure 7:
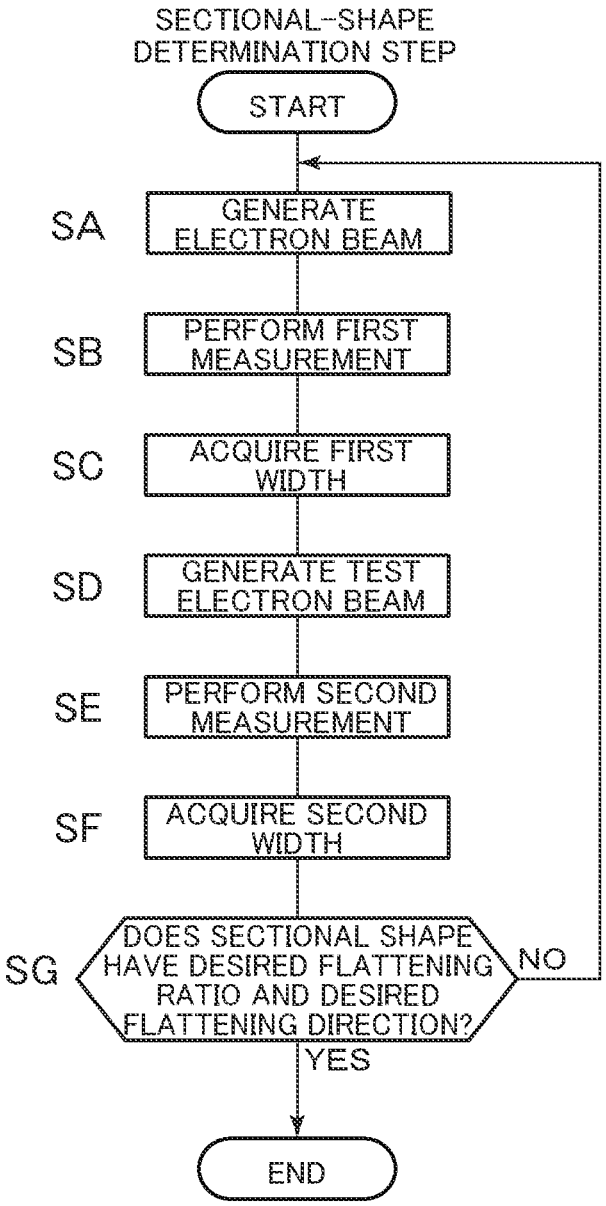
FIG. 7 is a flowchart for illustrating a sectional-shape adjustment step according to the embodiment of the present invention.

FIG. 7 is a flowchart for illustrating a sectional-shape adjustment step according to this embodiment. The deforming and rotating coil control unit 43 causes the set current to flow through the two coil sets (quadrupole coils) of the deforming and rotating coil 13 so that the deforming and rotating coil 13 generates an electron beam that is predicted to have a cross section on the rotor target 17 with a desired flattening ratio and a desired flattening direction (SA: electron-beam generation step). As described above, as the electron beam passes through the focusing coil 14, the cross section of the electron beam rotates. In consideration of the rotation angle, the deforming and rotating coil control unit 43 determines the current to flow through the deforming and rotating coil 13.

Next, the first measurement is carried out (SB: first measurement step). In this step, the first measurement is the same as the first measurement that is carried out in the focal spot adjustment step described above. However, the sectional shape of the electron beam on the rotor target 17, which is a target to be measured, is different. Through the first measurement, the amounts of detected electrons at the plurality of positions are acquired.

Subsequently, the first width that is the width of the cross section of the electron beam on the electron target along the first direction is acquired. The first width is acquired based on the results of detection in the first measurement step (SC: first width acquisition step). Specifically, the results of the first measurement are input to the CPU 40 to create a detected electron profile. The CPU 40 obtains the width from a shape of the detected electron profile. A known width of the second metal (W) is subtracted from the obtained width so as to acquire the width (first width) of the cross section of the electron beam on the rotor target 17 along the first direction.

Figure 8:
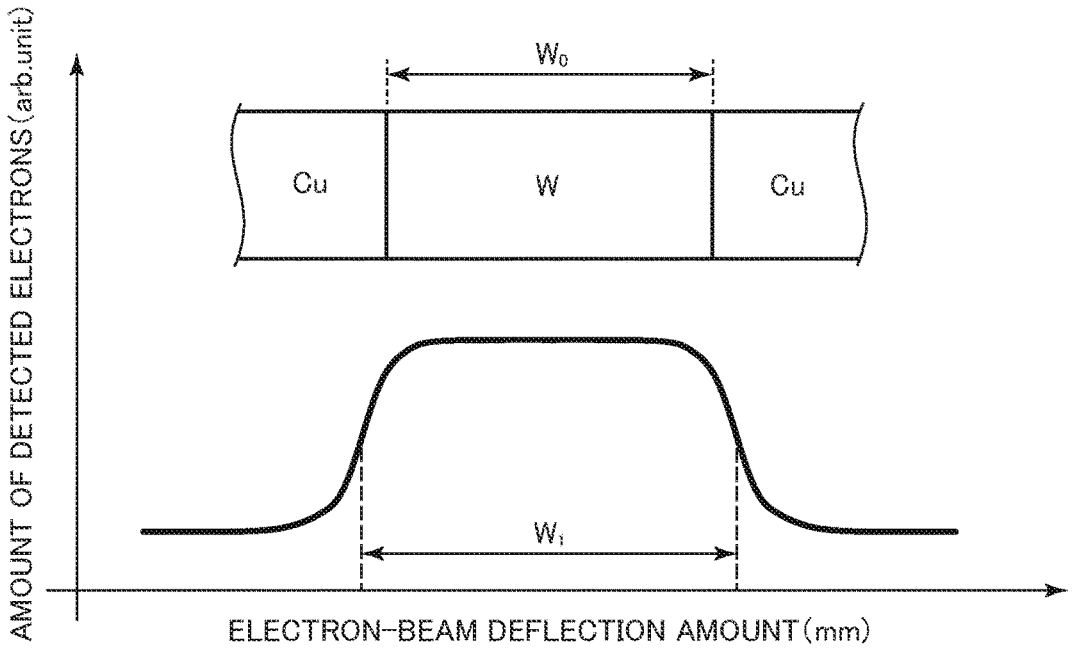
FIG. 8 is a graph for showing an example of analysis in the sectional-shape adjustment step according to the embodiment of the present invention.

FIG. 8 is a graph for showing an example of analysis in the sectional-shape adjustment step according to the embodiment. In FIG. 8, a detected electron profile obtained by plotting the results of the first measurement is shown. An average of the amounts of detected electrons when the cross section of the electron beam is entirely contained in the region of the first metal (third metal) is obtained, thereby acquiring the amount of detected electrons from the first metal (third metal). Similarly, an average of the amounts of detected electrodes when the cross section of the electron beam is entirely contained in the region of the second metal is obtained, thereby acquiring the amount of detected electrons from the second metal. Then, an electron-beam deflection amount (position of electron-beam scanning) at the amount of detected electrons that is an average value of the amount of detected electrons from the first metal (third metal) and the amount of detected electrons from the second metal is calculated. A length between the electron-beam deflection amount at the amount of detected electrons which is the average value of the amount of detected electrons from the first metal and the amount of detected electrons from the second metal and the electron-beam deflection amount at the amount of detected electrons which is an average value of the amount of detected electrons from the second metal and the amount of detected electrons from the third metal is defined as a width W1. A value obtained by subtracting a width W0 of the second metal from the width W1 is the width (first width) of the cross section of the electron beam along the flattening direction.

Next, as illustrated in FIG. 7, a test electron beam is generated (SD: test electron-beam generation step). In this step, the cross section of the test electron beam on the rotor target 17 is obtained by rotating the cross section of the electron beam generated on the rotor target 17 in the electron-beam generation step (SA). The test electron beam is obtained by rotating the cross section of the electron beam so that the second direction of the cross section of the electron beam on the rotor target 17 is oriented to the first direction of the cross section of the test electron beam on the rotor target 17. A deflecting direction of the deflecting coil 15 is the first direction. In this case, the second direction is a direction perpendicular to the deflecting direction of the deflecting coil 15. The cross section of the electron beam is rotated by 90° to obtain the test electron beam.

Then, the second measurement is carried out (SE: second measurement step). In this step, the second measurement is the same measurement as the first measurement. However, the second measurement differs from the first measurement in that a target to be measured is the test electron beam. The scanning of the test electron beam in the first direction corresponds to the scanning of the electron beam generated in the electron-beam generation step (SA) in the second direction.

Further, the second width that is the width of the cross section of the test electron beam on the electron target along the first direction is acquired (SF: second width acquisition step). The width of the cross section of the test electron beam along the first direction corresponds to the width of the cross section of the electron beam generated in the electron-beam generation step (SA) along the second direction. Based on the results of detection in the second measurement step, the second width is acquired.

Whether or not the generated electron beam has the cross section with the desired flattening ratio and the desired flattening direction is determined from the first width and the second width of the cross section of the electron beam (SG: sectional-shape determination step). From the first width and the second width of the sectional shape of the electron beam, the beam size of the electron beam is obtained. When the control unit 18 determines that the sectional shape of the electron beam is not the desired one, the deforming and rotating coil control unit 43 of the control unit 18 causes currents having different values to respectively flow through the two coil sets (quadrupole coils) of the deforming and rotating coil 13 so that the deforming and rotating coil 13 generates an electron beam having a different cross section. Even for the thus generated electron beam, the first measurement and the second measurement are repeated to acquire the first width and the second width. The above-mentioned operation is repeated. After the control unit 18 determines that the sectional shape of the electron beam is the desired one in the sectional-shape determination step, the adjustment of the electron beam is terminated. Then, after an X-ray tube current is reset to a value at the time of generation of the X-ray, a desired X-ray is emitted.

It is desirable that not only the sectional shape of the electron beam on the rotor target 17 be elliptical with the desired flattening ratio but also the flattening direction (long axis direction) coincide with the axial direction of the rotor target 17. More precisely, the flattening direction (long axis direction) of the cross section of the electron beam is adjusted so that the take-off direction of the X-ray in which the X-ray window 30 is arranged and the flattening direction of the cross section of the electron beam form the same plane.

As described above, the cross section of the electron beam rotates as the electron beam passes through the focusing coil 14. The rotation angle depends on the focusing-coil current. Therefore, the control unit 18 determines the current to flow through the deforming and rotating coil 13 so that the cross section of the electron beam on the rotor target 17 has the desired flattening direction after the above-mentioned rotation. For example, the flattening direction is gradually changed with the flattening ratio being fixed. In other words, the cross section is gradually rotated with the sectional shape itself of the electron beam being fixed. For each angle, the first width and the second width are acquired. When the first width becomes maximum (the second width becomes minimum), the flattening direction of the cross section of the electron beam on the rotor target 17 coincides with the first direction (electron-beam scanning direction). In this manner, the control unit 18 can control the flattening direction of the cross section of the electron beam.

The main characteristic of the X-ray generator according to this embodiment lies in that the second metal that is the metal band to be used for the adjustment of the electron beam is formed on the side surface of the rotor target 17. In this manner, the emitted electrons are detected while scanning the electron beam in the first direction so that the beam size (length along the first direction) of the electron beam on the rotor target 17 can be acquired. Based on the detected electrons obtained from the electron-beam deflection amount, the focusing of the electron beam and the adjustment of the sectional shape of the electron beam can be performed.

The first metal, the second metal, and the third metal are arranged on the side surface of the rotor target 17 side by side along the first direction. Therefore, the electron beam is scanned in the first direction so that the length (first width) of the cross section of the electron beam along the first direction can be acquired. However, even when the electron beam is scanned, for example, in a direction perpendicular to the first direction, the number of emitted electrons remains unchanged due to the structure of the rotor target 17. Therefore, the length along the direction perpendicular to the first direction cannot be acquired. In this embodiment, however, the electron beam cross-section shaping unit changes the sectional shape of the electron beam to rotate the cross section of the electron beam so that the second direction is oriented to the first direction. Through the scanning of the test electron beam in the first direction so as to acquire the width along the first direction, the length (second width) of the electron beam along the second direction can also be acquired. As a result, the focusing of the electron beam and the adjustment of the sectional shape of the electron beam can be performed more precisely.

In the example of the adjustment method according to the embodiment described above, the current flowing through the focusing coil 14 is adjusted so that the sectional shape of the electron beam on the rotor target 17 is reduced in the focal spot adjustment step (S3). However, the adjustment method is not limited thereto. When the focal spot of the electron beam on the rotor target 17 is a micro focal spot having the beam size of, for example, smaller than 10 μm, the adjustment of the flattening ratio and the flattening direction of the electron beam in the sectional-shape adjustment step (S4) only needs to be performed under a state in which the electron beam is out of focus, specifically, under a state in which the beam size of the electron beam on the rotor target 17 is larger than the desired beam size. Thereafter, the focal spot adjustment step (S3) is carried out for the electron beam having the above-mentioned sectional shape. In this case, the value of the focusing-coil current that gives the desired focal spot size only needs to be obtained by extrapolation from the detected electron profiles at some focusing-coil currents. In this case, the current to flow through the deforming and rotating coil 13 is further corrected in consideration of the rotation angle after the passage through the focusing coil 14.

The X-ray generator according to the embodiment of the present invention and the adjustment method therefor have been described above. The X-ray generator according to the present invention can be widely applied without being limited to the above-mentioned embodiment. For example, although the electron target in the embodiment described above is the rotor target, the electron target may also be a planar target. The present invention is applicable even to the planar target by arranging the first metal, the second metal, and the third metal, each having a band-like shape, side by side. Further, each of the electron-beam adjusting unit and the electron-beam deflecting unit included in the X-ray generator according to the embodiment described above includes (the plurality of) coils to magnetically control the electron beam. However, the electron-beam adjusting unit and the electron-beam deflecting unit are not limited thereto, and may be realized by other elements having similar functions.

What is claimed is:

1. An X-ray generator, comprising:

an electron target comprising a first metal, a second metal different from the first metal, and a third metal different from the second metal, which are sequentially arranged side by side along a first direction in a continuous manner;

an electron-beam generating unit configured to emit an electron beam to be radiated on the electron target;

an electron-beam adjusting unit, which is arranged between the electron-beam generating unit and the electron target, and is configured to adjust the electron beam emitted from the electron-beam generating unit;

an electron-beam deflecting unit, which is arranged between the electron-beam adjusting unit and the electron target, is configured to deflect the electron beam to be radiated on the electron target in the first direction and further comprising an electron beam cross-section shaping unit; and an electron detector, which is arranged between the electron-beam adjusting unit and the electron target, and is configured to detect electrons emitted from the electron target wherein the X-ray generator is configured to perform:

a first measurement including:

scanning, by the electron-beam deflecting unit, the electron beam so that a position of the electron beam on the electron target is moved from the first metal to the third metal; and detecting, by the electron detector, the electrons emitted from the electron target at each of a plurality of the positions of the electron beam on the electron target;

test electron beam generation including generating, by the electron beam cross-section shaping unit, a test electron beam, of which a cross section on the electron target has a shape obtained by rotating the sectional shape of the electron beam on the electron target so that the first direction of the cross section of the test electron beam is coincident with a second direction, intersecting with the first direction, of the sectional shape of the electron beam; and a second measurement including:

scanning, by the electron-beam deflecting unit, the test electron beam so that a position of the test electron beam on the electron target is moved from the first metal to the third metal; and detecting, by the electron detector, the electrons emitted from the electron target at each of a plurality of the positions of the test electron beam on the electron target.

2. An adjustment method for an X-ray generator, the X-ray generator comprising an electron target comprising a first metal, a second metal different from the first metal, and a third metal different from the second metal, which are sequentially arranged side by side along a first direction in a continuous manner, the adjustment method comprising:

performing a first measurement including:

scanning the electron beam so that a position of the electron beam on the electron target is moved in the first direction from the first metal to the third metal; and detecting electrons emitted from the electron target at each of a plurality of the positions of the electron beam on the electron target; and acquiring a first width of a cross section of the electron beam along the first direction based on results of detection in the performing of the first measurement; generating a test electron beam, of which a cross section on the electron target has a shape obtained by rotating the sectional shape of the electron beam on the electron target so that the first direction of the cross section of the test electron beam is coincident with a second direction, intersecting with the first direction, of the sectional shape of the electron beam;

performing a second measurement including:

scanning the test electron beam so that a position of the test electron beam on the electron target is moved in the first direction from the first metal to the third metal; and detecting electrons emitted from the electron target at each of a plurality of the positions of the test electron beam on the electron target; and acquiring a second width of the cross section of the electron beam along the second direction based on results of detection in the performing of the second measurement.

* * * * *